United States Patent [19]

Hunt

[11] 4,027,722

[45] June 7, 1977

[54] ELECTRON BEAM FURNACE

[75] Inventor: Charles d'A. Hunt, Larkspur, Calif.

[73] Assignee: Airco, Inc., Montvale, N.J.

[22] Filed: July 27, 1965

[21] Appl. No.: 477,357

Related U.S. Application Data

[63] Continuation-in-part of Ser. No. 255,625, Feb. 1, 1963, abandoned.

[52] U.S. Cl. ..... 164/64; 164/254; 266/208

[51] Int. Cl.[2] ..... B22D 11/10

[58] Field of Search ..... 266/34, 38, 24, 33, 266/208–211, 215; 164/48, 49, 250, 63, 64, 254, 50, 52, 61, 62, 82, 250; 13/31; 75/49, 65 EB

[56] References Cited

UNITED STATES PATENTS

| | | | |
|---|---|---|---|
| 2,859,262 | 11/1958 | Harders et al. | 266/34 X |
| 2,882,570 | 4/1959 | Brennan | 164/64 |
| 2,893,715 | 7/1959 | Harders et al. | 266/34 |
| 3,050,798 | 8/1962 | Chambers | 164/64 |
| 3,125,440 | 3/1964 | Hornak et al. | 266/34 |
| 3,157,922 | 11/1964 | Gruber | 164/250 X |
| 3,230,074 | 1/1966 | Roy et al. | 266/34 V |
| 3,310,850 | 3/1967 | Armbruster | 164/64 |
| 3,342,250 | 9/1967 | Treppschuh et al. | 266/108 X |

*Primary Examiner*—Gerald A. Dost
*Attorney, Agent, or Firm*—David A. Draegert; Edmund W. Bopp; Larry R. Cassett

[57] ABSTRACT

A method and apparatus for manufacturing steel and other alloys by vacuum refining are disclosed. One preferred apparatus comprises a series of vacuum chambers, one containing an electron beam heating means, and a second containing a means for adding an alloying constituent. Apparatus for melting, transferring, and casting metals is also disclosed.

15 Claims, 8 Drawing Figures

INVENTOR.
CHARLES d'A. HUNT

BY

Lippincott, Ralls & Hendrickson
ATTORNEYS

INVENTOR.
CHARLES d'A. HUNT

BY

Lippincott, Ralls & Hendrickson
ATTORNEYS

INVENTOR.
CHARLES d'A. HUNT

BY

Lippincott, Ralls & Hendrickson
ATTORNEYS

INVENTOR.
CHARLES d'A. HUNT

BY

Lippincott, Ralls & Hendrickson
ATTORNEYS

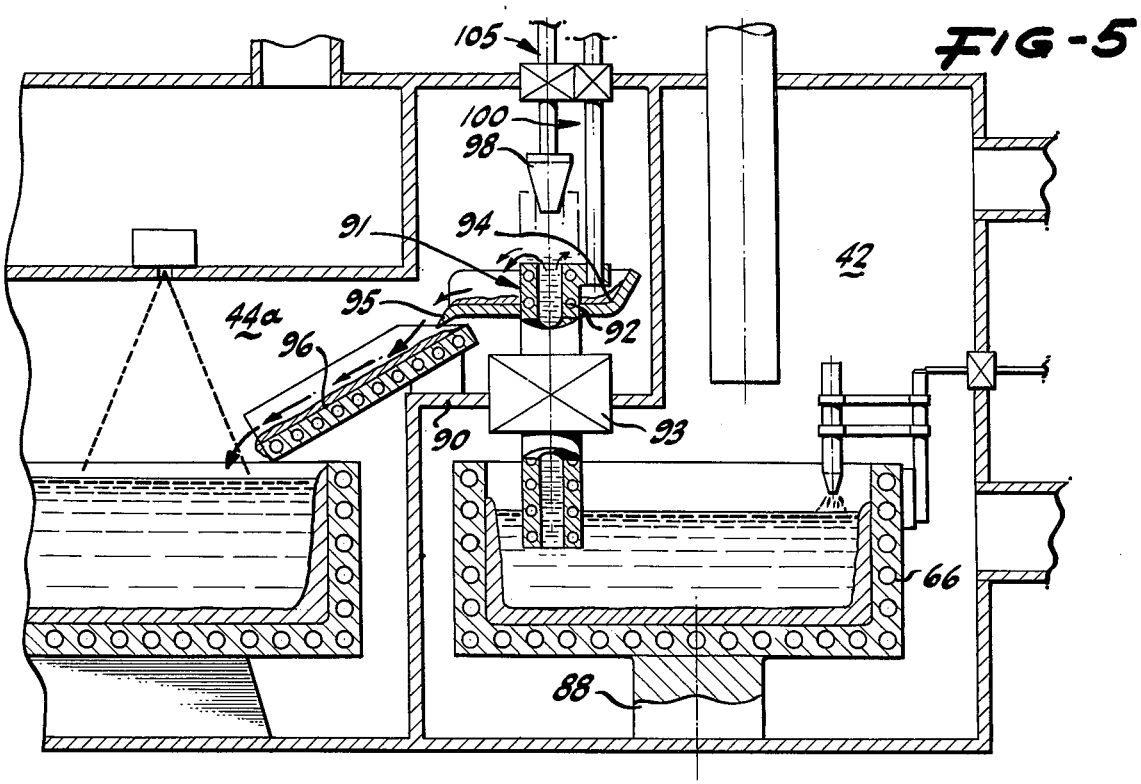
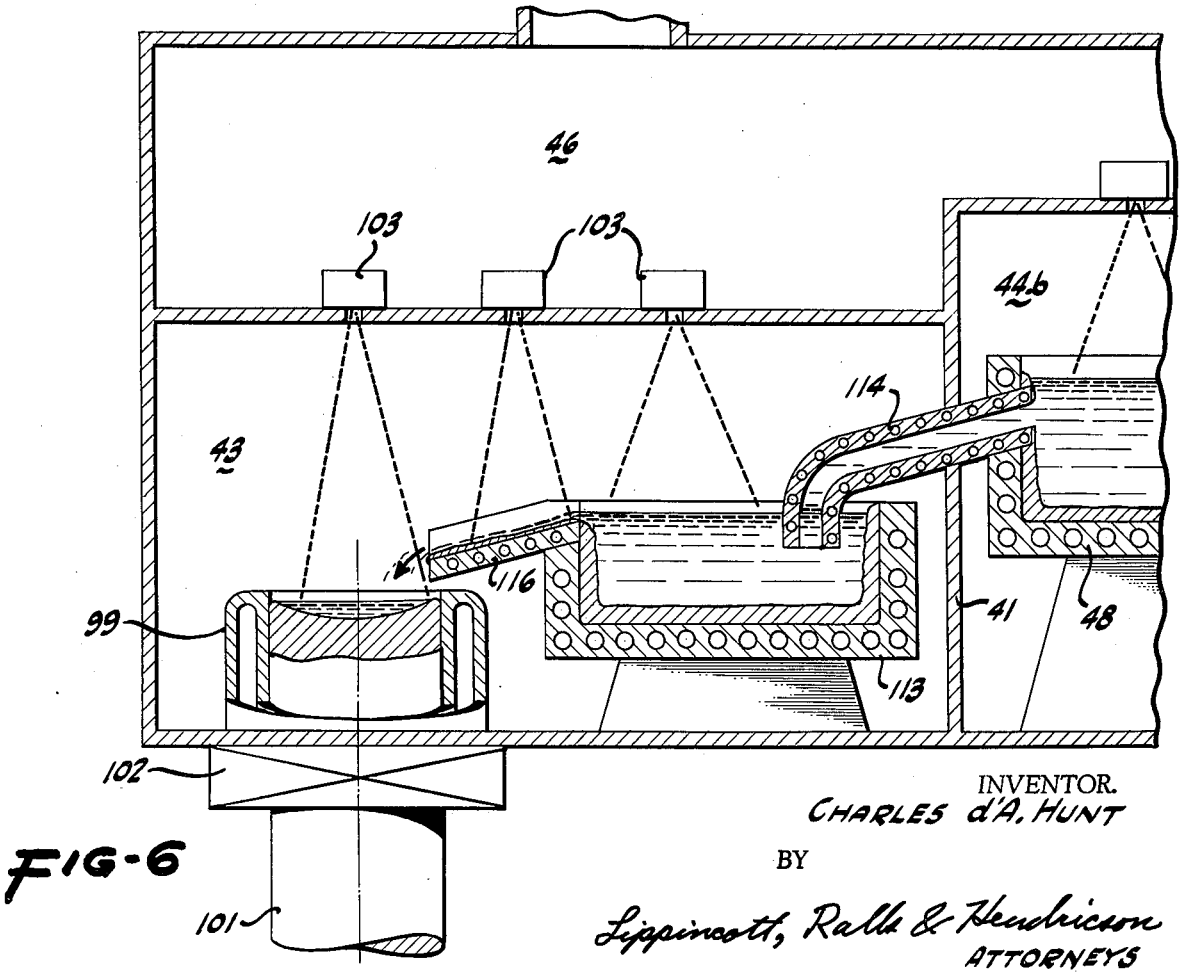
FIG-6
INVENTOR.
CHARLES d'A. HUNT
BY
Lippincott, Ralls & Hendrickson
ATTORNEYS INVENTOR.
CHARLES d'A. HUNT

BY

Lippincott, Ralls & Hendrickson
ATTORNEYS

Inventor
Charles d'A. Hunt
By Anderson, Luedeka, Fitch, Even & Tabin
Atty's

ELECTRON BEAM FURNACE

This application is a continuation-in-part application of application Ser. No. 255,625, filed 1 Feb. 1963, and now abandoned.

This invention relates to improved apparatus for the continuous zone vacuum processing of metallic materials, and is particularly directed to a continuous zone high vacuum furnace featuring improved arrangements for feeding material to the furnace and withdrawing material therefrom which facilitate a relatively high throughput of material, simplification in structure, and other advantages over existing furnaces of this type.

Processes of melting and casting metallic ores to obtain relatively pure metals or alloys are well known wherein high temperatures are employed to separate slag and burn off or evaporate volatile impurities from the molten material. Conventional furnaces, for example, have long been employed in the conduct of these processes to obtain a fair degree of purity in the processed material, primarily by the establishment of a surface layer of solid impurities floating naturally as a slag upon the surface of the molten metal which may accordingly be readily removed by scraping or the like. To a lesser extent conventional furnaces effect removal of volatile impurities, however, the concentration of volatile impurities removed is limited by the atmospheric gases required to efficiently support the arc heating process conventionally employed. More particularly, in the presence of atmospheric gases equilibrium conditions are reached where some of the gaseous impurities evolved dissolve back into the melt. Accordingly, high level purification is preferably accomplished by the employment of high vacuum furnaces. Not only can slag be removed from the melt in this type of furnace, but, in addition, volatile impurities and occluded gases are evolved more readily from the melt to the surrounding high vacuum furnace volume and are continuously exhausted therefrom. Since vacuum conditions are continuously maintained and a concentration of gaseous impurities therefore cannot accumulate, the volatile impurities and the like evolved from the melt cannot be replaced by the same or similar impurities dissolved back thereinto.

Until recently, high vacuum furnaces have been generally adapted to only interrupted zone processing of metals, and accordingly have been limited to rather small production capacities. However, by means of the high vacuum furnace disclosed in my copending application, Ser. No. 183,841, continuous zone processing of metal is facilitated at production rates of an industrial scale. More particularly, in this type of furnace a hearth is provided which extends through a number of high vacuum chambers. Feed stock, usually in relatively crude form, is continuously fed into a vacuum chamber at the inlet end of the hearth and is therein heated and melted by charged particle bombardment and is delivered into the hearth. Solid impurities float atop the melt as a slag, and such slag is advantageously removed as by means of scrapers or the like at the inlet end of the hearth. Some of the volatile impurity content of the melt is evolved in the vacuum chamber surrounding the inlet end of the hearth and is removed by exhaustion through the vacuum pumping means associated with the chamber. The melt, as thus partially purified, progresses along the hearth by gravity feed into one or more high vacuum purification zones and is therein subjected to further particle bombardment which maintains the melt in molten condition and adds additional heat thereto. As a result, the melt is continuously purified as it progresses along the hearth by the further evolution of gases and volatile impurities which are removed from the vacuum chamber by the vacuum pumping system. Finally, at the outlet end of the hearth, the melt in highly purified molten form is delivered into a cold mold, or the like, to be therein solidified and formed into an ingot of high purity metal which may be continuously delivered from the vacuum furnace.

Although vacuum furnaces of the type outlined hereinbefore for the continuous zone processing of metal represent a substantil advancement in the art, particularly as to their increased production capacity, various improvements are possible which serve to increase the performance and enhance the versatility of furnaces of this type, as well as simplify their design. More particularly, it will be appreciated that where solid feed stock is introduced to the furnace and melted in vacuo for delivery into the inlet end of the hearth, the molten metal being thereafter gravity fed along the hearth, the throughput of metal is somewhat limited since there is a limit as to the volumetric rate as which solid feed stock can be practicably melted and delivered into the hearth. In addition, since the solid feed stock is commonly in a relatively crude form, a substantial amount of impurities are contained therein. Hence, when the crude feed stock is melted in the furnace, substantial amounts of slag are formed upon the melt at the inlet end of the hearth and a relatively large volume of gaseous impurities are evolved therefrom. As a result, slat removal apparatus is required at the inlet end of the hearth to remove the slag. The employment of such slag removal apparatus entails the provision of sealed vacuum locks in association therewith, thus materially increasing the complexity and expense of the furnace. Furthermore, vacuum pumps having a large capacity are required in association with the inlet stage of the furnace to remove from the vacuum chamber the large volume of gaseous impurities evolved during melting of the feed stock. This further detracts from the efficiency of existing continuous zone vacuum furnaces and adds to their operational expense.

The outlet stage of continuous zone vacuum furnaces as they have existed heretofore has commonly been maintained at relatively high vacuum. As a consequence, the conventional type of cold mold with a skull pool of molten metal maintained at its upper end, as disposed in the outlet stage, has required a relatively effective sealed vacuum lock to facilitate egress of the ingot of purified metal to the atmosphere. Furthermore, a conventional cold mold with high vacuum seal lock is not particularly suited to the formation of small diameter bars of metal at high linear rates.

Since both the inlet and outlet stages of existing continuous zone vacuum furnaces are commonly maintained at relatively high vacuums, the use of certain types of heating mechanisms has been precluded therein. Electric arc heating, for example, is not efficient at very low pressures.

Accordingly, it is a primary object of the present invention to improve existing types of continuous zone vacuum furnaces to the ends of overcoming the limitations and disadvantages noted hereinbefore.

Another object of the invention is the provision of an improved continuous, unidirectional flow vacuum furnace for the purification processing of metals at relatively high throughputs heretofore unattainable. More specifically, the present invention provides an initial input or receiving zone which is adapted to receive metal in premelted condition at about atmospheric pressure or above, or at a low order vacuum from a conventional smelting furnace or the like. As employed herein, atmospheric pressure is defined as including low order vacuums of, for example, 100 millimeters of mercury absolute or higher in addition to atmospheric pressure and pressures in excess of atmospheric. Heating means in the receiving zone maintain the metal molten, and a unique pressure feed mechanism is employed to continuously feed the molten metal to a hearth extending through one or more vacuum processing zones which are sealed from the receiving zone. The pressure feed mechanism utilizes the pressure difference between the pressure in the receiving zone and relatively lower pressure in the processing zone to force the flow of molten metal continuously from the receiving zone into the hearth in the processing zone at a substantial flow rate. The pressure feed mechanism and the introduction of the feed stock into the receiving zone in premelted condition at substantial volumes, facilitates a relatively large throughput of metal. In addition, a separate outlet or casting zone may be advantageously provided in the furnace to receive the purified molten metal from the processing zone. The casting zone may be sealed from the processing zone, and accordingly may be maintained at a relatively higher pressure than the processing zone. The pressure in the casting zone may be atmospheric pressure or may be a relatively low order vacuum similar to that employed in the receiving zone, for example, above about 100 millimeters of mercury absolute. The establishment of a relatively higher pressure in the casting zone allows the use of cold molds having less effective vacuum seals and allows the formation and withdrawal of ingots to the atmosphere at relatively high linear rates.

Yet another object is the provision of a method and apparatus for the manufacture of alloys of specific composition. More specifically, it is an object to provide a means for the addition of alloying agents to the molten material in the processing zone or zones and to provide for establishment of desired pressures within the processing zones during addition of the alloying elements.

Still another object of the invention is the provision of an improved vacuum furnace of simplified, economical design. By virtue of the atmospheric pressure receiving zone for receiving metal in premelted condition in accordance with the present invention, the problems of slag removal and large capacity evacuation of volatile impurities in the initial stages of the furnace are greatly reduced. The premelted metal may be introduced to the receiving zone from auxiliary conventional smelting equipment in an already partially purified state wherein the major portion of slag has been removed and the metal has not been contaminated with air, water and the like. Slag removal apparatus and large capacity pumping means are consequently not required in association with the initial stages of the vacuum furnace.

It is yet another object of the invention to provide an improved vacuum furnace which is versatile in operation. The separate receiving and outlet zones of the improved furnace may be operated at relatively high pressure as well as low pressure to facilitate the employment of electric arcs, plasma bombardment sources and the like as heating means therein, in addition to electron and ion bombardment sources.

It is a further object of the present invention to provide an improved continuous zone vacuum furnace of the class described wherein start-up and shut-down procedures may be readily accomplished.

Further objects and advantages of this invention will become apparent upon consideration of the following detailed description of particular preferred embodiments of the invention in conjunction with the accompanying drawings, wherein:

FIG. 5 is a view similar to FIG. 4, but depicting a modified form of pressure feed means in accordance with the present invention;

Figure 7:
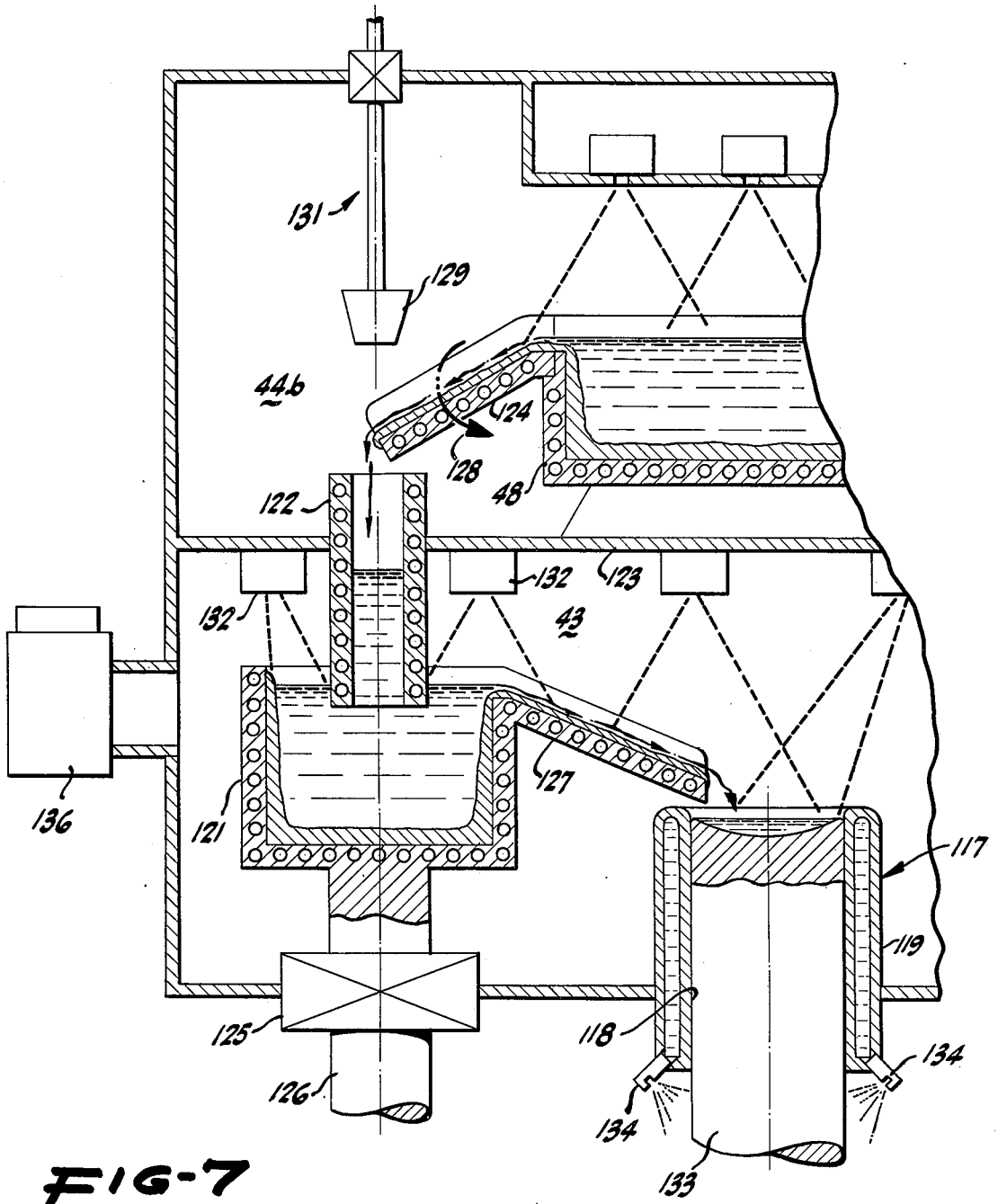

FIG. 6 is a fragmentary longitudinal sectional view, on an enlarged scale, taken at central vertical plane through the casting zone of the furnace depicting a modified form of apparatus which may be employed therewith; and FIG. 7 is a view similar to that of FIG. 6, depicting another modified form of apparatus which may be employed in the furnace to facilitate rapid egress of highly purified metallic ingots therefrom.

Figure 8:
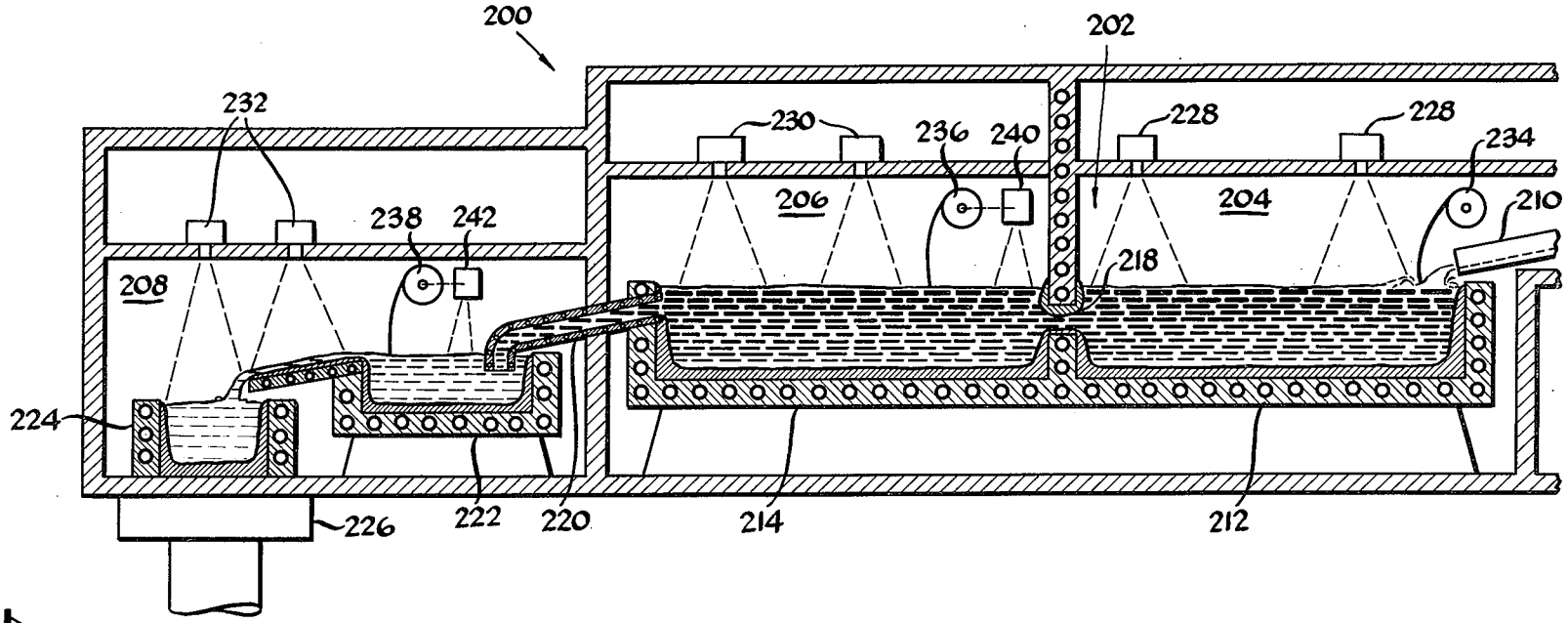

FIG. 8 is a fragmentary, schematic cross-sectional view of a further embodiment of a vacuum furnace in accordance with the present invention.

Figure 1:
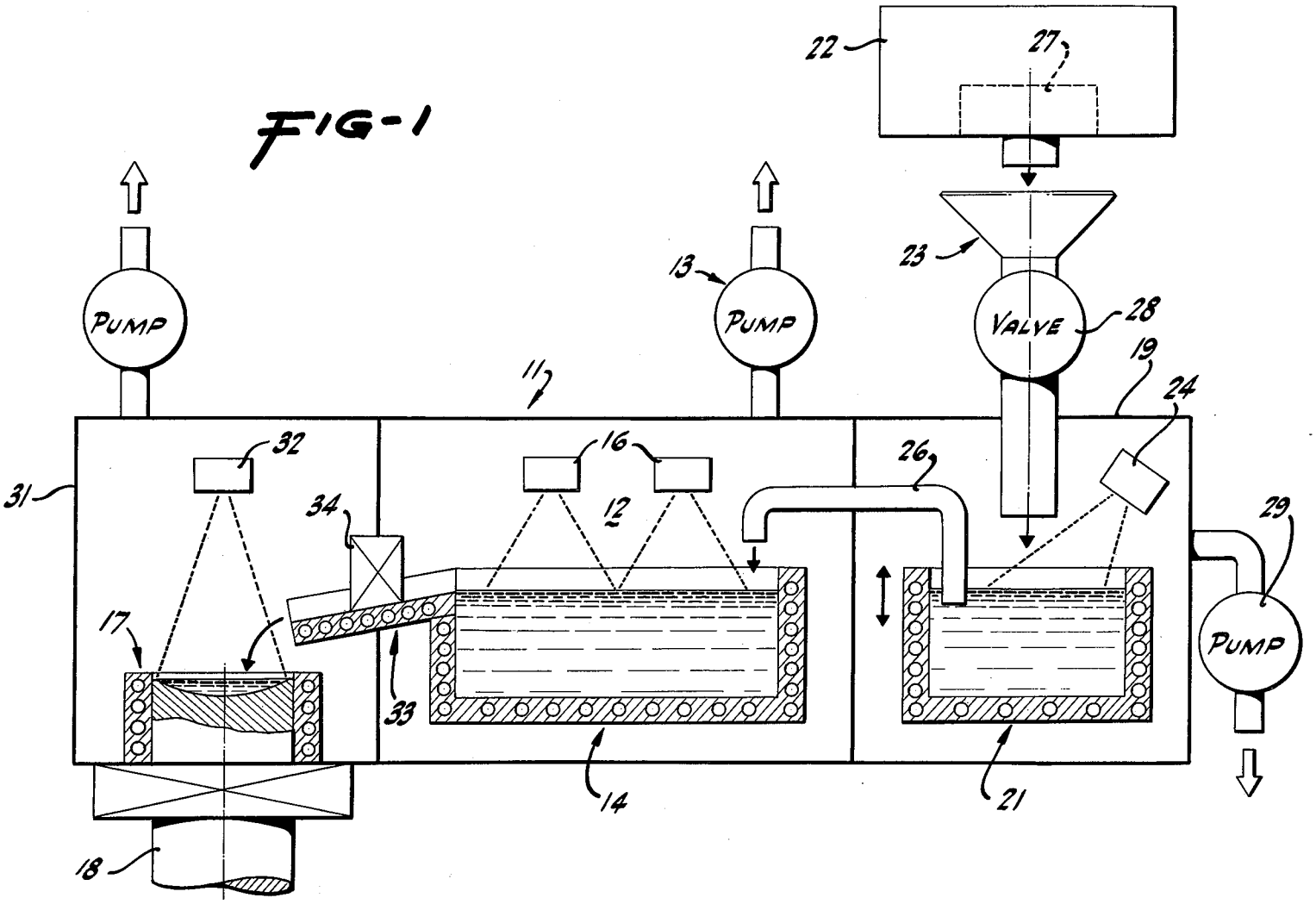
FIG. 1 is a partial schematic cross-sectional elevational view in a central plane of a continuous zone vacuum furnace in accordance with one embodiment of the present invention.

Referring to FIG. 1, there is shown a continuous zone vacuum furnace which includes a vacuum enclosure 11 defining high vacuum processing zone 12 having one or more processing stages continuously maintained as by means of vacuum pumping means 13. Means are provided within the processing zone 12 to contain molten material, e.g., an open hearth 14 which extends longitudinally through the zone 12. Commonly, the flow of material along the hearth 14 is effected by gravity feed in one continuous path through the processing zone, and molten material introduced into an inlet end of the hearth 14 continuously flows through the zone 12 to the outlet end of the hearth. The material is maintained molten and additional heat is imparted thereto in flowing along the hearth 14 by bombarding beams of charged particles directed thereon from suitably disposed charged particle sources 16, such as electron guns, ion sources, or the like. By virtue of the heating of the molten material flowing along the hearth 14 and the maintenence of a high vacuum, various volatile impurities and occluded gases are evolved to the surrounding vacuum and directly exhausted through the pumping means 13 such that the impurities cannot be redissolved in the molten material. The molten material is hence continuously purified in passing through the processing zone 12 such that the material in reaching the outlet end of the hearth possesses a very high purity. From the outlet end of the hearth, the molten material is continuously cast into a cold mold 17, or the like, in a casting zone 31 which facilitates the continuous egress of material from the furnace in the form of, for example, high purity ingots 18.

In general respects, the high vacuum purification processing arrangement just described is similar to that included in the vacuum furnace of my copending application, Ser. No. 183,841. In accordance with the present invention, this type of furnace is improved by the provision of a separate inlet or receiving zone 19 which is sealed from the processing zone 12. The receiving zone 19 is arranged to facilitate introduction of melt stock to the processing zone 12 in a premelted condition. More particularly, the receiving zone 19 houses a receptacle 21 into which feed stock is continuously introduced, preferably in premelted condition from a source 22 of molten material, such as a conventional smelting furnace. To this end, the receiving zone 19 is preferably provided with a hopper 23, or equivalent means for conveying molten material from the source 22 to the receptacle 21. Such introduction of molten material to the receptacle 21 would be extremely difficult, if not impossible, to accomplish where it required that a vacuum be maintained within the receiving chamber. The receiving zone 19, however, is open to atmosphere during introduction of the molten material to the receptacle such that large volume continuous flow of premelted material to the receptacle is readily accomplished. By virtue of the material being premelted in the auxiliary source 22, a major portion of the slag is removed from the feed stock prior to introduction of the feed stock into the receiving zone 19. Slag removal problems, and the accompanying vacuum locks and hardware, are consequently obviated. Furthermore, when it is necessary to periodically remove slag from the molten material within the receptacle 21, such removal can be readily accomplished without regard to the provision of vacuum seal locks in association with the slag removal apparatus, since the receiving zone is at atmospheric pressure. In addition, the molten material being fresh from the auxiliary source, air, water and the like which are usually added during a typical ingot making step have not had an opportunity to contaminate the material deliered into the receptacle 21. The vacuum pumping means 13 associated with the processing zone 12 may accordingly be of decreased capacity, since the molten material introduced thereto is relatively free of such contaminants.

In addition to the foregoing, several other advantages accrue from the provision of the separate atmospheric pressure receiving zone 19. More particularly, it will be appreciated that heat must be applied to the material to maintain same in molten flowable condition during all phases of processing in the furnace. In the processing zone 12, the heat is supplied by the bombardment sources 16. Heat must, of course, be also supplied to the material in the receiving zone 19, and to this end a heat source 24 is provided. It is particularly important to note that by virtue of the atmospheric pressure receiving zone, various heating means may be employed as heat source 24 which have been heretofore precluded because they are not efficiently operable at low pressures. For example, the heat source 24 may be an electric arc heater. As is well known, electric arc heating is highly efficient when conducted at a relatively high pressure approaching atmospheric. Other forms of heating means may, of course, be alternatively employed, such as plasma torch sources, which are also efficient at relatively high pressures approaching atmospheric, or in low order vacuums which may likewise be maintained in the receiving zone if desired.

The atmospheric pressure receiving zone 19 also facilitates the introduction of molten material to the processing zone 12 at relatively high volumetric flow rates by means of a unique pressure feed mechanism. More particularly, it should be noted that inasmuch as the receiving zone 19 is at atmospheric pressure, or at a low order vacuum, whereas the processing zone 12 is maintained at a relatively high vacuum, a substantial pressure gradient exists therebetween and such gradient is advantageously employed in accordance with the present invention to effect continuous feed of the molten material from the receptacle 21 to the heart 14. In this regard, means are provided such as a flow tube 26 to define a flow path extending from beneath the level of molten material in the receptacle 21 and into the processing zone 12, in vacuum sealed relation thereto, to a position wherefrom molten material is delivered to the inlet end of the hearth 14. The flow tube 26 extends beneath the level of molten material in the receptacle 21 and thereby establishes a vacuum seal between the receiving zone 19 and the processing zone 12. The relatively high pressure in the receiving zone 19 acts upon the surface of the molten material within the receptacle 21 and forces the molten material in the receptacle 21 to continuously flow through the flow tube 26 into the hearth 14 at a relatively high flow rate. It should also be noted that inasmuch as the flow tube 26 extends beneath the level of the molten material within the receptacle 21, any slag floating atop the melt therein does not enter the flow tube 26. Accordingly, the molten material introduced to the hearth is substantially free of slag.

The receiving zone 19 may be constructed as a portion of the enclosure housing the purification zone 12, or may be a separate enclosure, as desired.

The receiving zone 19, adapted to be maintained at substantially atmospheric pressure, and the pressure feed mechanism for continuously introducing molten material to the hearth 14 within the processing zone 12, allow for easy start-up and shut-down of the furnace. When it is desired to shut down the furnace under conditions of continuous feed of molten material into the receptacle 21 and continuous feed of such molten material from the receptacle 21 into the hearth 14, the flow of molten material into the receptacle may first be stopped, as by means of a suitable shut-off mechanism 27, such as a gate, operatively associated with the source 22. Termination of flow from the receptacle 21 to the hearth may be facilitated by evacuating the receiving zone to a low pressure at which the molten material will not flow from the receptacle 21 onto the hearth 14. This may be advantageously accomplished as by means of a vacuum valve 28 disposed within the hopper which is operable to vacuum seal the hopper and receiving zone 19 from outside atmosphere. Vacuum pump means 29 communicating with the receiving zone 19 may then be actuated to evacuate the receiving zone to a sufficiently low pressure at which the pressure gradient existing between the receiving zone and processing zone is insufficient to cause flow of molten material through the tube 26 extending therebetween.

It is desirable that provision be made to drain the flow tube 26 subsequent to the termination of molten material feed therethrough. More particularly, in order that the heat source 24 may be de-actuated, the flow path must first be drained for otherwise the molten material therein would solidify and block the path for subsequent operations. Accordingly, heating of the molten material within the receptacle 21 is preferably not terminated until the vacuum seal between the flow tube 26 and the molten material within the receptacle 21 is broken to thereby effect draining of the flow tube. To break the vacuum seal, the receptacle 21 and flow tube 26 are preferably mounted for relative movement. For example, the flow tube 26 may be fixed and the receptacle 21 mounted for translation towards and away from the flow tube, or alternatively, the receptacle may be fixed and the flow tube translatable towards and away from the receptacle. When the vacuum seal is broken between the flow tube and the molten material within the receptacle, and draining of the flow tube is thus effected, heating may be terminated. At this time, of course, the receiving zone 19 is for communication with the processing zone 12 through the flow tube 26. The high vacuum within the processing zone 12 is maintained inasmuch as the receiving zone has been previously evacuated to a low pressure. Hence, there is no substantial loss of vacuum within the processing zone during shut-down.

To facilitate start-up of the furnace subsequent to a shut down of the type just described, heating of the material within the receptacle 21 is resumed while low pressure is maintained within the receiving zone 19. When a suitable molten pool is obtained within the receptacle 21 and a supply of molten feed stock is provided within the auxiliary source 22 of molten material, immersion of the flow tube 26 within the molten pool within the receptacle 21 is effected by moving same relative to each other to thus establish a vacuum seal between the receiving zone 19 and the processing zone 12. The vacuum valve 28 is then opened and the pumping means 29 de-energized whereby the pressure within the receiving chamber is rapidly raised to atmospheric. A substantial pressure gradient is thus re-established between the receiving zone and processing zone and pressure feeding of molten material from the receptacle 21 to the hearth 14 is re-established. The flow shut-off mechanism 27 is then opened to re-establish continuous flow of molten material into the receptacle 21 before the level of material therein drops sufficiently to break the vacuum seal.

In addition to the improvements in continuous zone vacuum furnaces just described, the present invention provides for the enclosing of the cold mold 17, molds for batchwise casting, or other casting means, within a separate casting or outlet zone 31, which is arranged to be vacuum sealed from the processing zone 12. By virtue of this separate casting zone the cold mold 17 may be disposed within pressure surroundings different from those persisting within the purifying zone 12. Means are provided to establish a sealed flow path for the molten material between the hearth 14 in the processing zone and the cold mold 17 in the casting zone. A sealed flow path facilitates delivery of the molten material from the hearth to the casting mold while at the same time maintaining the processing and casting zones in vacuum sealed relation to each other. Various alternatives are of course possible in the means for establishing a sealed flow path, and the selection of any given means for this purpose depends to a large extent upon the particular pressures desired in the respective processing and casting zones. For example, where the casting zone pressure is to be relatively low and not substantially greater than the pressure within the processing zone, a pressure sealed flow path may be provided as depicted in FIG. 1. A tundish 33 extends from the outlet end of the hearth into the casting zone 31 to a position of delivery overlying the cold mold 17. A baffle at the barrier between the purification and casting zones extends into the tundish to a sufficient depth that the baffle is immersed in molten material flowing through the tundish thereby establishing a vacuum 34. Of course, where it is desired to maintain a relatively high pressure approaching atmospheric, within the casting zone while the processing zone is maintained at a relatively high vacuum, a more effective form of sealed flow path is required in order to maintain a vacuum seal between the respective zones. In this regard, alternative embodiments for providing a sealed flow path suitable where it is desired to maintain a substantial pressure differential between the casting and processing zones are depicted in FIGS. 6 and 7, and subsequently described in detail herein.

In order that the material within the cold mold 17, or other casting means, be maintained in a molten condition, a heat source 32 is provided to deliver heat energy thereto. Various types of heat sources may be employed to the foregoing end, the particular pressure existing within the casting zone 31 being particularly influential in the selection of the type of heat source. When the casting zone is maintained at a relatively high vacuum, electron or ion bombardment sources may be utilized as the heat source 32 in the conventional manner. However, when the casting zone is maintained at atmospheric or other relatively high pressures, various heating means may be employed to maintain the material within the cold mold 17, or other casting means, in molten condition, which could not be heretofore efficiently employed by virtue of their inefficiency at high vacuum. For example, an electric arc heating source, plasma torch or the like may be employed to heat the material within the cold mold 17 when the casting zone is operated at relatively high pressures approaching atmospheric. It should also be noted that other advantages accrue when the casting zone is maintained at relatively high pressure; for example, seal problems encountered in removal of the ingot 18 to the atmosphere are manifestly reduced.

Figure 2:
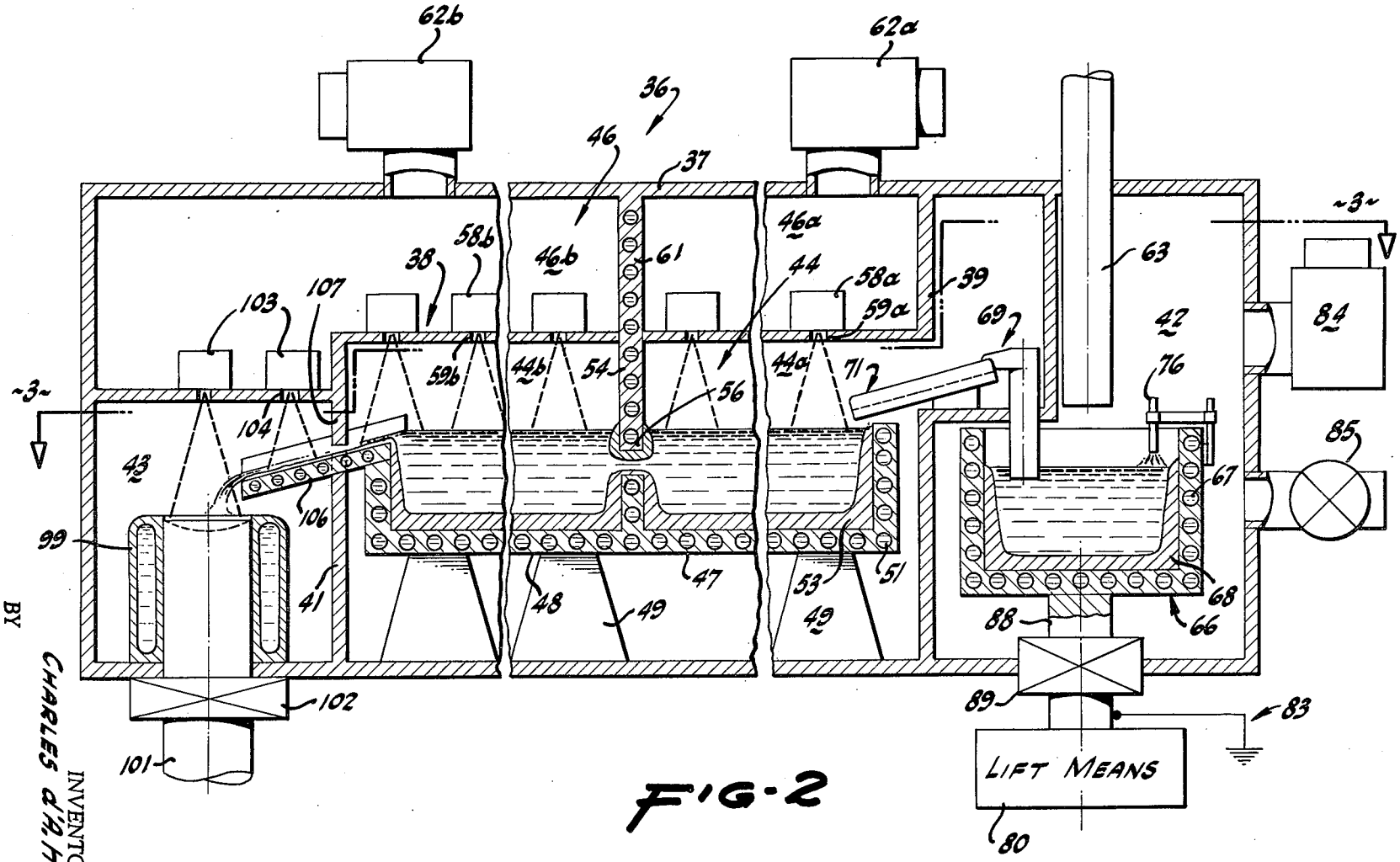
FIG. 2 is a partial schematic cross-sectional elevational view in a central plane of another embodiment of a continuous zone vacuum furnace in accordance with the present invention.
Figure 3:
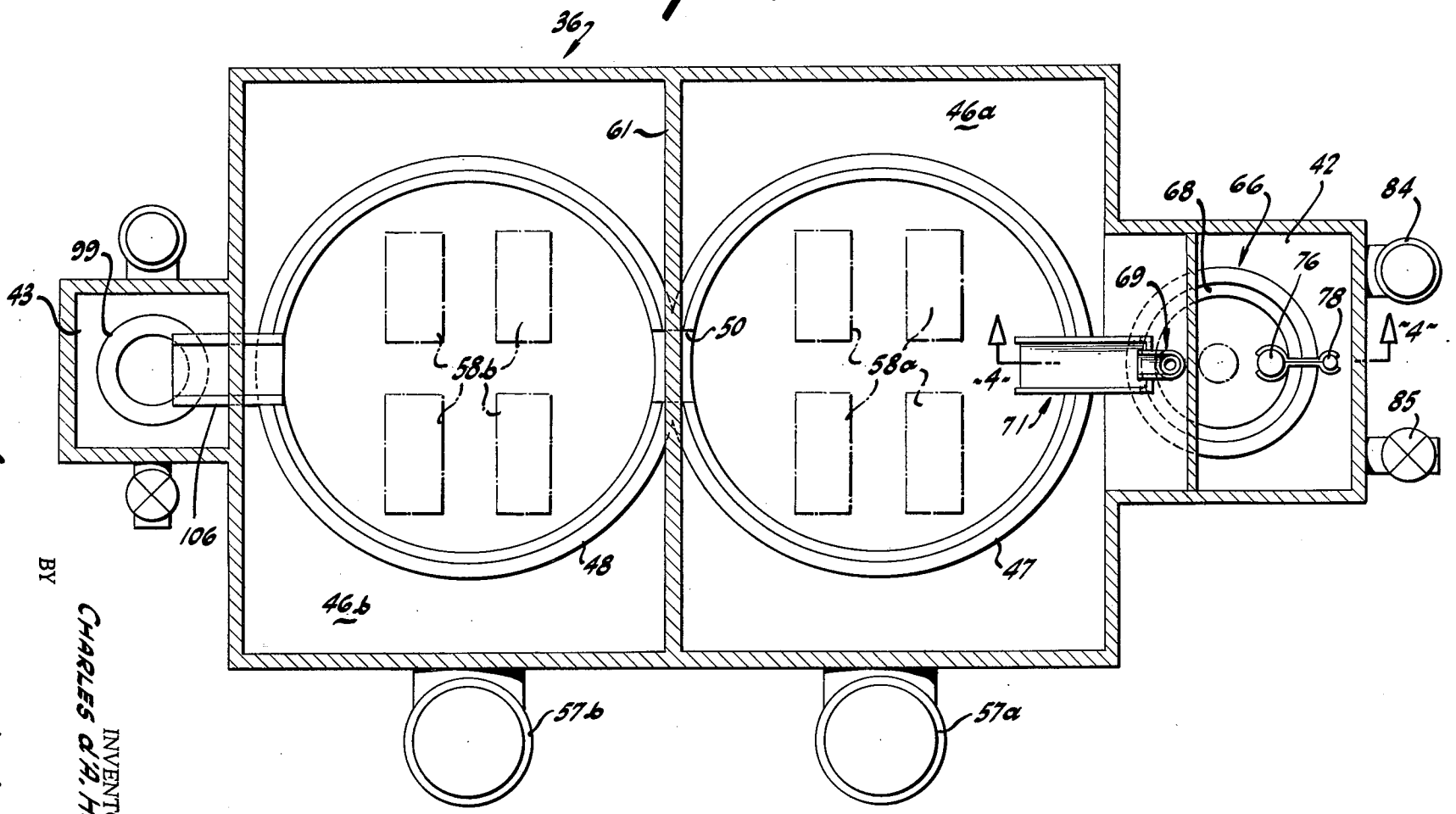
FIG. 3 is a horizontal sectional view taken at line 3—3 of FIG. 2, with overlying elements depicted in phantom.

Considering now preferred structure of a continuous zone vacuum furnace embodying the improvements of the present invention, and referring particularly to FIGS. 2 and 3, an improved alloying furnace is designated by the numeral 36. The furnace 36 includes an enclosure 37 in which horizontal transverse wall structure 38 and transverse vertical barrier walls 39 and 41 are provided to partition the interior of the housing into a receiving zone 42, a casting zone 43 and a processing zone 44, interposed therebetween. In addition, a source chamber 46 is defined within the housing in overlying relation to the processing casting zones. Within the processing zone 44 there is provided a plurality of open top cylindrical hearth pots disposed in horizontal longitudinal alignment, adjacent pots being in tangential contact. As depicted in FIGS. 2 and 3, two of these pots 47 and 48 are horizontally supported within the processing zone 44 upon stantions 49, or the like. The pots 47,48 are in tangential contact and have common wall structure along the vertical median plane of the housing 37. This common wall structure of the pots is recessed to define a channel 50 therebetween to facilitate the flow of molten material from one pot to the other. The peripheral walls of the pots are preferably provided with passages 51 for the circulation of coolant therethrough. The pots 47 and 48 thus define a cold hearth within the processing zone which in general respect is similar to that employed in the continuous zone vacuum furnace of my copending application, Ser. No. 183,841. It should be noted, however, that the circular pot configuration facilitates relatively long residence times of molten material therein and is particularly well suited to alloying processes, described hereinafter, wherein various alloy additions may be made to the melt in the respective pots, under varied pressure and temperature conditions. It is also important to note that, as illustrated in the drawings, the material within the hearth pots is in direct contact with the cold wall surfaces thereof, rather than through the more usual intermediary of an insulating liner of refractory material, or the like. Certain materials such as steel may be advantageously processed in this manner in direct contact with the cold wall surfaces of the hearth, as well as other molten material carrying components of the furnace. Aside from the resulting simplification in design of these components, skull removal problems in the furnace are simplified. More particularly, the skulls 53 inherently formed at the cold wall surfaces of the hearth, and elsewhere in the furnace, are in direct contact with metallic surfaces, not with refractory material surfaces of a liner. The skulls may accordingly be more readily removed, inasmuch as the process material cannot permeate the metallic surfaces as it does the relatively porous refractory material surfaces of a liner. Certain materials, such as copper and aluminum, cannot be processed in direct contact with cold metallic surfaces, in which cases liners may be provided within the hearth pots, and elsewhere in the furnace 36.

To facilitate the attainment of different temperature and pressure conditions surrounding the respective pots 47,48, a transverse vertical partition 54 depends from the horizontal wall structure 38 and is provided with a central baffle 56 which projects into the channel 50 to a position beneath the surface of molten material within the pots but upwardly spaced from the base of the channel. The baffle hence permits flow between the pots, but effectively divides the processing zone 44 into a first stage **44*a* ecompassing the pot 47 and a second stage 44*b* encompassing the pot 48. Vacuum pumps 57*a* and 57*b* communicated with stages 44*a* and 44*b* through, for example, a side wall of the housing 37, may then be employed to evacuate the respective stages of the processing zone to different pressures as may be required in the conduct of an alloying process. Further to the foregoing, varied temperature conditions may be established within the respective pots 47,48 through the provision of separately controlled bombardment heating sources 58*a* and 58*b* disposed within the source chamber 46 and directing beams of charged particles through apertures 59*a*, 59*b* provided in the horizontal wall structure 38, into the melt contained within the respective pots 47,48. The source chamber may be partitioned, as indicated at 61, to provide separate source stages 46*a*, 46*b* respectively containing the arrays of sources 58*a* and 58*b*. The separate source stages 46*a*, 46*b* may hence be separately evacuated as by means of vacuum pumps 62*a*, 62*b* respectively communicated therewith as through the top of the housing 37. Separate source pressures may thus be maintained in the stages 46*a*, 46*b* in suitable relationship to the vacuum pressures existing in the respective stages of the processing zone 44. The horizontal wall structutre 38, of course, functions as a vapor barrier in the manner disclosed in my copending application, Ser. No. 183,841 to protect the bombardment sources. With regard to the bombardment sources 58,** same may be of Various types depending upon the pressures required within the various stages of the processing zone. Where high vacuums are involved, the sources are commnly provided as electron or ion guns. It is apparent that any number of stages may be employed in the processing zone, or a single processing stage may be utilized, depending upon the material being processed. Further, the electron beam gun heating sources need not be disposed above the hearth, and may be disposed adjacent to and below the level of the hearth or at some other convenient location if so desired.

Considering now the receiving zone 42 of the furnace in grater detail, it is to be noted that the receiving zone is separated from the first stage **44*a* of the processing zone by the vertical transverse barrier wall structure 39. A tubular inlet chute 63 extends through the top wall of housing 37 into the receiving zone 42. Only a fragmentary portion of the chute 63 is depicted in FIG. 2, and it is to be understood that the chute is comparable to the hopper 23 mentioned hereinbefore for facilitating the introduction of premelted material to the receiving zone frm an auxiliary furnace or equivalent source of premelted material. More particlarly, it is to be understood that the chute contains a vacuum valve (not shown) comparable to the vacuum valve 28.**

Figure 4:
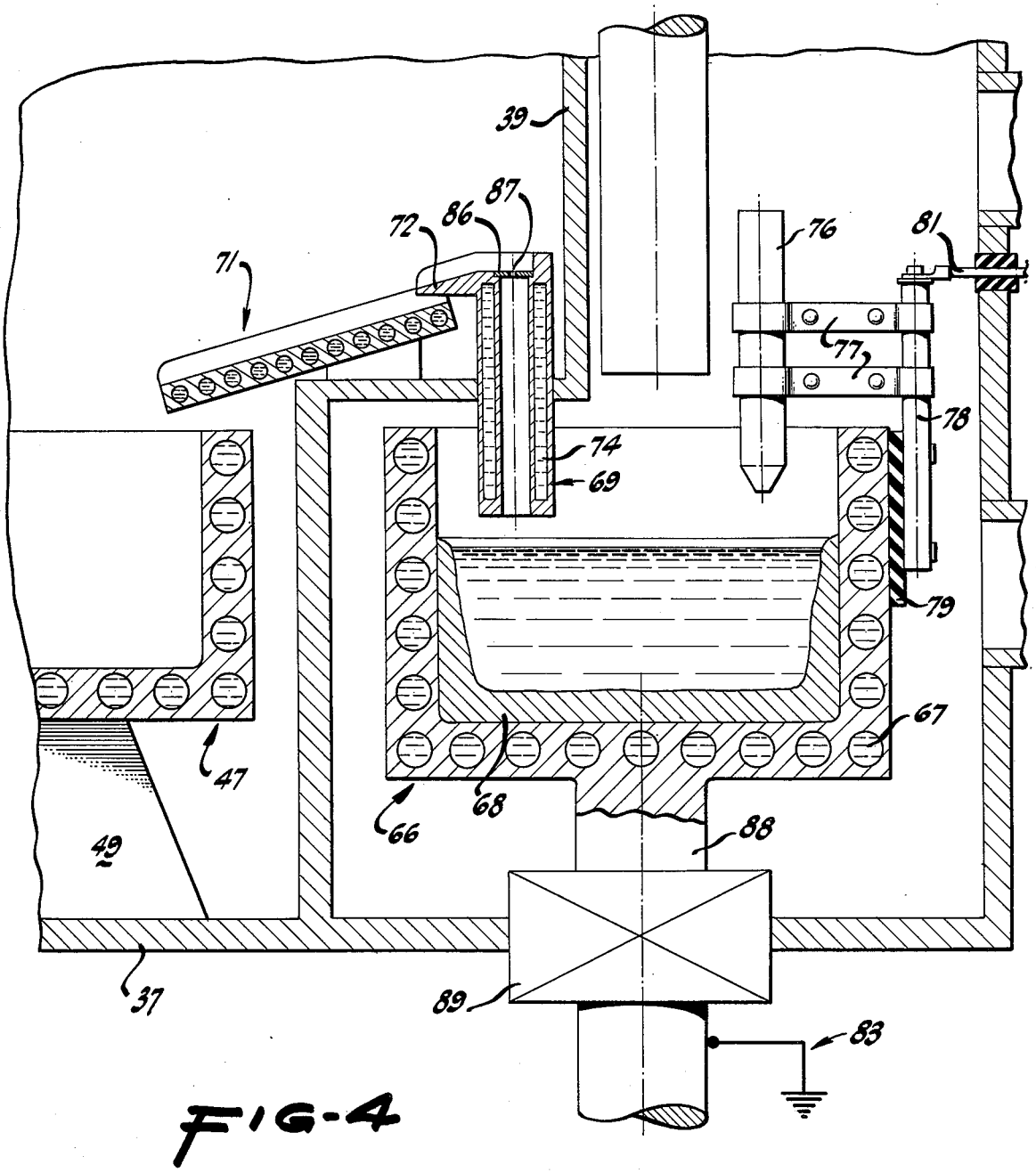
FIG. 4 is a fragmentary sectional view, on an enlarged scale, taken at line 4—4 of FIG. 3, and illustrating particularly an atmospheric pressure receiving zone and pressure feed means for feeding molten metal from the receiving zone to a vacuum processing stage in accordance with the present invention.

Within the receiving zone 42, there is provided a receiving pot 66, preferably of open top cylindrical configuration, subjacent the lower end of chute 63. The pot 66 hence defines a receptacle of the variety discussed hereinbefore relative to the general arrangement of FIG. 1. The peripheral wall of the pot 66 is preferably formed with passages 67 for the circulation of a coolant therethrough, and when molten material contacts the cold metallic interior wall surfaces of the pot a skull 67 is formed in direct contact therewith. In the instant embodiment, a flow path is defined between the pot 66 within the receiving zone and the pot 47 within the first stage **44*a* of the processing zone by a feed tube 69 and a tundish 71. More particularly, the feed tube 69 extends vertically through a horizontally disposed offset portion of the transverse vertical wall structure 39 in vacuum sealed fixed relation thereto, The feed tube 69 extends into the pot 66 to a sufficient depth that the lower end of the tube is immersible below the surface of molten material filling the pot. The upper end of the tube is disposed within the first stage 44*a* of the processing zone 44, and is provided with a spout or equivalent means for directing molten material fed upwardly through the feed tube 69 upon the tundish 71 for conveyance to the pot 47. The walls of the feed tube are preferably formed with coolant passages 74, as best shown in FIG. 4,** to facilitste maintenance of the feed tube walls at a non-destructive relatively cool temperature during the passage of high temperature molten material therethrough.

Although heating of material introduced to the receiving pot 66 through the chute 63 to maintain such material in molten condition may be variously accomplished, as noted hereinbefore, electric arc or plasma torch heating is preferably employed to this end when the receiving zone is adapted to be maintained at or near atmospheric pressure. More particularly, a plasma torch may be disposed adjacent the receiving pot 66, or as illustrated in FIG. 4, a non-consumable arc electrode 76 may be provided with an end projecting interiorly of the pot to a position subjacent the level of the rim thereof. Support of the electrode in the foregoing position is accomplished by means of brackets 77 secured at one of their ends to the electrode and at their other ends to a post 78 secured to the exterior surface of the pot while being electrically isolated therefrom as by means of an interposed insulator 79. The post 78 and brackets 77 are of electrically conducting material such that high voltage applied to the post by means of a high tension lead 81 connected thereto and extending exteriorly through the wall of the housing 37 in insulated relation thereto, is likewise applied to the arc electrode 76. Hence, when molten material within the receiving pot 66 is maintained at ground potential, an arc is struck between the electrode and the surface of the molten material, To facilitate grounding of the molten material within the pot, the peripheral wall of the pot may be grounded as indicated at 83, in any conventional manner.

To facilitate evacuation of the receiving zone 42 when desired, a vacuum pump means 84, comparable to the pump 29 previously mentioned, may be provided. Hence the vacuum valve associated with the chute 63 and the vacuum pump means 84 facilitate the selective establishment of atmospheric or low pressure conditions within the receiving zone 42 for start up and shut down of the furnace. An added degree of pressure control is advantageously facilitated by a second vacuum valve 85 communicated with the receiving zone 42 and ported to atmosphere. The valve 85 facilitates the porting of small quantities of air to atmosphere, to in turn provide a relatively close control over the pressure within the receiving chamber.

With molten material introduced to the receiving pot 66 through the entrance chute 63 and the level of molten material within the pot sufficient to immerse the end of the feed tube 69, the molten material within the receiving pot is continuously fed through the feed tube 69 into the pot 47 disposed within processing stage **44*a* due to the difference in pressure between the receiving zone 42, maintained at atmospheric pressure, and stage 44*a* maintained at a low pressure. It should be noted that under conditions of initial start-up when no molten material is contained within the receiving pot 66, the receiving zone 42 and first stage of the processing zone are in communication through the feed tube 69. Accordingly, the processing stage 44*a* could not normally be evacuated to high vacuum preparatory to the start of the process. Were the pot 66 to be filled to a sufficient level to immerse the end of the feed tube 69 and thereby seal the processing stage 44*a* from the receiving zone 42, and then stage 44*a* evacuated to a suitable high vacuum requisite to feeding of the molten material, a substantial delay in starting the continuous zone processing would, of course, be encountered. Furthermore, vacuum conditions in the stage 44*a* would be relatively unconstant during the initial portion of the process. Accordingly, it is desirable that means be provided to temporarily seal the feed tube 69 and hold the vacuum within the stage 44*a* prior to initial start-up. One such means for sealing the feed tube 69 is depicted in FIG. 4 wherein a diaphragm 86 of relatively low melting point metal such as aluminum, and having a small aperture 87, is secured in sealing relation to the upper end of the feed tube 69. Such diaphragm serves to seal the stage 44*a* from the receiving chamber 42 until such time as the molten material within the receiving pot 66 rises to a sufficient level to immerse the end of the feed tube. A high vacuum may hence be maintained within the stage 44*a* prior to initial start-up. When the end of the feed tube 69 is immersed within the molten metal within the receiving pot, the molten metal rises upwardly in the tube and contacts the diaphragm. As a result, the diaphragm is melted and the vacuum seal is maintained by the molten material enveloping the lower end of the feed tube. Pressure feed of the molten material from the receiving pot 66 through the feed tube then commences immediately, inasmuch as a suitable pressure gradient has been maintained between the receiving chamber and vacuum stage prior to start-up. It should be noted that the feed is effected strictly by the pressure gradient inasmuch as the flow tube extends upwardly a sufficient distance that the head of molten material therein counteracts the head of molten material within the receptacle acting at the immersed end of the feed tube, plus the atmospheric pressure acting at the surface of the molten material within the pot. The molten material fed through the tube is streamed upon the tundish 71, to in turn flow therealong into the pot 47. It is apparent that other forms of seals, such as a valve, may be employed to seal the feed tube 69**.

Shut-down of the furnace 36 may be accomplished, in the manner previously described relative to the general embodiment of FIG. 1, by first terminating the introduction of molten material to the entrance chute 63 and closing the receiving zone 42 from atmosphere through actuation of the vacuum valve associated with the entrance chute 63 and vacuum valve 85. The pump means 84 is then operable to evacuate the receiving chamber to low pressure, at which time the feed tube 69 may be withdrawn from the molten material within the receiving pot 66 by effecting relative movement between the pot and the feed tube. As mentioned previously, this terminates flow between the receiving pot and the hearth pot 47 and enables high vacuum to be maintained within the stage **44*a*. Discontinuance of heating of the material within the receiving pot may then be readily effected by extinguishing the arc emanating from the electrode 76, extinguishing the plasma torch, or otherwise deenergizing whatever heating means are employed in the receiving chamber. In the instant embodiment the previously noted relative movemen between the receiving pot 66 and feed tube 69 is accomplished by moving the pot relative to the tube, which is in fixed position. More explicitly, the receiving pot 66 is preferably provided with a centrally depending pedestal 88 extending through a seal lock 89 in the base of the receiving chamber in slidable relation thereto. Movement of the receiving pot towards and away from the feed tube may then be effected by a pneumatic, hydraulic or other suitable form of lift system, as generally depicted at 80, in operable association with the pedestal 88**.

Start-up of the furnace 36 after a shut-down of the type just described is, of course, effected upon reestablishment of the arc from electrode 76, or otherwise resuming heating in the receiving chamber, to melt the material within the receiving pot, and elevation of the receiving pot to a level whereat the end of the feed tube is immersed. The receiving zone 42 is then ported to atmosphere, by means of the vacuum valves associated therewith, to initiate flow of the molten material from the receiving pot 66 to the hearth pot 47. The introduction of premelted material to the receiving pot through the entrance chute 63 is then resumed.

It will be appreciated that various alternatives are possible to provide for relative movement between the receiving pot 66 and feed tube 69, and in this regard reference is made to FIG. 5, which illustrates a modified form of feed arrangement wherein the receiving pot 66 is fixed and the feed tube is movable. More particularly, in the modified embodiment, the pedestal 88 of the receiving pot is fixedly secured to the base of the receivng zone 42. A movable feed tube 91 is then provided which is preferably formed with coolant passages 92 in the walls thereof to facilitate cooling of the tube to a suitably low non-destructive temperatutre during the flow of hot molten material therethrough. The tube 91 extends vertically through a seal lock 93 in a horizontal offset portion 90 of the partition 39, and is slidable therein. Suitable conventional translating means 100, for example a pneumatically actuated piston, are associated with the tube 91 to facilitate selective vertical movement thereof into and out of the receiving pot 66. When the lower end of the tube 91 is immersed in the molten material within the receiving pot, the receiving zone 42 is, of course, sealed from the processing stage 44*a;* and when atmospheric pressure is established within the receiving zone, a sufficient pressure gradient exists between the opposite ends of the feed tube to force the molten material from the receiving pot upwardly through the tube and out of its upper end into the stage 44*a* of the processing zone. Suitable means are provided in stage 44*a* to receive the molten material streaming from the upper end of the tube 91 and convey same to the hearth pot 47. For example, a cup 94 may be concentrically secured about the tube 91 subjacent its upper end to collect the molten material streaming therefrom. A pouring lip 95 formed in the cup then facilitates introduction of the molten material collected therein to a tundish 96 extending from a position subjacent the lip to a position overlying the hearth pot 47. The tundish thus conveys the molten material received from the lip 95 to the hearth pot. As a further feature of the instant embodiment, provision is made to seal the tube 91 during its withdrawal from the receiving pot. One means for accomplishing the foregoing may comprise, for example, a movable plug 98 disposed in coaxial alignment with the tube 91 and sealingly engageable with the upper end thereof. Suitable conventional translating means 105, such as a pneumatically actuated piston, associated with the plug are best provided to facilitate vertical movement thereof into and out of sealing engagement with the upper end of the feed tube. Such means facilitates initial start-up of the furnace without requirement of the diaphragm 86. More particularly, with the plug 98 translated downwardly by the translating means 105 into sealed engagement with the upper end of feed tube 91, the receiving zone 42 is sealed from stage 44*a* and the latter may be maintained at a high vacuum. The arc from electrode 76 is struck, and molten material is introduced through entrance chute 63 to the receiving pot 66, the arc maintaining the material within the pot in molten condition. If the feed tube is not already vertically positioned such that its lower end extends somewhat below the level of the rim of the receiving pot to be thereby immersible within molten material filling same, the feed tube and plug may be translated simultaneously downwardly to such a vertical position. In this manner, sealing of the feed tube is maintained even during movement thereof. When the level of molten material within the receiving pot rises sufficiently to envelop the lower end of the feed tube and thereby establish a vacuum seal thereat, the translating means 105 is actuated to withdraw the plug from sealed engagement with the upper end of the feed tube. As an alternative, the feed tube might, of course, be translated downwardly out of engagement with the plug. In either case, upon opening of the upper end of the feed tube, the pressure gradient between the atmospheric pressure in the receiving zone and the vacuum in stage 44*a* is effective in feeding molten material from the receiving pot 66 to the hearth pot 47.

Shut-down and subsequent start-up of the furnace may be thereafter effected in a manner analogous to that described relative to the embodiment of FIGS. 2 to 4. Shut-down is accomplished by terminating the introduction of molten material to the entrance chute 63 and evacuating the receiving zone to a low pressure insufficient to feed molten material through the tube 91. The feed tube 69 is now translated upwardly to withdraw its lower end from molten material within the receiving pot 66. As a result, the molten material drains from the feed tube, whereupon the arc from electrode 76 may be extinguished to terminate heating of the material contained within the receiving pot. Start-up of the furnace may be subsequently effected by resuming heating of the material within the receiving pot, translating the feed tube downwardly to a position of immersion within the molten material within the receiving pot, re-establishing atmospheric pressure within the receiving zone, and resuming the introduction of molten material to the receiving pot through the entrance chute.

Considering now the casting zone 43 of the furnace 36, in greater detail, it is particularly important to note that transverse vertical wall structure 41 and horizontal wall structure 38 respectively isolate the casting zone from the processing zone 44 and source chamber 46. Any suitable means may be disposed within the casting zone 43 to continuously receive molten material from the hearth pot 48 within the processing zone. By virtue of the casting zone being isolated from the processing zone, whatever means are employed to continuously drain molten material from the hearth pot 48 may be maintained in a different pressure environment than exists in the processing zone. Where it is desired to maintain the casting zone 43 at a low pressure which is, however, somewhat greater than that existing in the last processing stage 44*b*, the casting zone may, for example, be arranged as depicted in FIGS. 2 and 3. More explicitly, a conventional cold mold 99 may be disposed within the casting zone 43 to continuously drain the hearth pot 48 of molten material and form same into ingots 101 for continuous ejection to the atmosphere through a seal lock 102, or the like, in the casting zone. In the instant embodiment, where the pressure differential between the casting zone and the last processing stage 44*b* is not substantial, a flow path between the hearth pot 48 and cold mold 99 may be defined by a cooled tundish 106 communicated with the hearth pot and transpiercing the partition 41 to extend to a position overlying the cold mold. Vacuum sealing of the flow path is then readily facilitated by a baffle 107 depending from the partition 41 into the tundish to a depth short of the base thereof, which is yet commensurate with immersion of the baffle in molten material flowing through the tundish. The baffle is being immersed within the molten material establishes a vacuum seal between the casting zone 43 and processing stage 44*b*, while permitting flow of molten material between the hearth pot 48 and cold mold 99. Heating of the material at the upper end of the cold mold and flowing through the tundish to maintain same molten is preferably accomplished in the instant embodiment, where the casting zone is maintained at relatively low pressure, by electron or ion bombardment heating sources 103 disposed within the source chamber 46 to direct beams of bombarding particles upon the mold and tundish through apertures 104 in the horizontal wall structure 38.

Referring now to FIG. 6, there is shown a modified arrangement for defining a vacuum sealed flow path extending from the hearth pot 48 within processing stage 44*b* to the cold mold 99, or other casting means, within the casting zone 43. With this modified embodiment, a more effective vacuum seal is provided than that provided by the embodiment of FIGS. 2 and 3; and accordingly, a greater pressure differential can be tolerated between the casting zone and the processing zone. As depicted in FIG. 6, a receiving pot 113 with cooled interior wall surfaces is provided within the casting zone 43, and this pot is communicated with the hearth pot 48 by means of a cooled feed tube 114. The feed tube extends from a position within the hearth pot 48 beneath the level of molten material contained therein, to a position beneath the level of molten material within the receiving pot 113, and in so doing transpierces the partition 41 in vacuum sealed relation thereto. Since the opposite ends of the feed tube 114 are respectively submerged beneath the levels of molten mateial within the hearth pot 48 and receiving pot 113, the tube provides a vacuum sealed flow path for molten material therebetween. It should be noted that the opposite ends of the feed tube are vertically displaced from each other by a sufficient distance that gravitational forces acting upon molton material flowing therethrough are sufficient to off-set any pressure gradient between the processing zone and casting zone which would tend to effect flow of molten material in a reverse direction from pot 113 to pot 48. Conveyance of molten material from the pot 113 to the cold mold 99 may in turn be facilitated in any suitable manner as by means of a cooled tundish 116 extending therebetween. In order that the material may be maintained in a molten condition during transit from the hearth pot 48 to the cold mold 99, heating means such as the bombardment sources 103 are provided to supply heat to the pot 113, tundish 116 and top of the cold mold 99 in a manner analogous to that described relative to the embodiment of FIGS. 2 and 3.

Considering now another modified arrangement for continuously delivering molten material from the processing zone to the casting zone, reference is made to FIG. 7 wherein an arrangement is shown which is particularly adapted to the formation of ingots and ejection of same to the atmosphere at relatively high linear rates. Within the casting zone 43 there is provided a cold mold 117 of generally conventional design, but having a relatively small diameter casting bore 118 circumscribed by a cooling jacket 119. The mold extends from within the casting zone to the exterior of the furnace. There is also provided within the casting zone a cooled receiving pot 121 which is communicated with the hearth pot 48 through a vacuum sealed flow path extending between the processing zone 44 and the casting zone 43. Preferably, the vacuum flow path is defined by a cooled feed tube 122 which extends in vacuum sealed relation through a horizontal wall partition 123 separating the processing zone 44 and the casting zone 43. A cooled tundish 124, or equivalent means, is provided within the processing zone 44 and extends from the hearth pot to a position overlying the tube to facilitate conveyance of molten material therebetween.

Means are provided for effecting relative movement between the feed tube 122 and receiving pot 121 whereby the lower end of the tube may be selectively immersed in molten material in the pot 121 or retracted therefrom. When the tube is immersed, a vacuum seal is formed in the flow path defined by the tundish and feed tube to thereby seal the processing zone and casting zone from each other. In the instant embodiment, the feed tube is fixed, while the receiving pot 121 is selectively vertically movable. To this end, the pot may be provided with a pedestal 126 which depends from the base of the pot and which extends exteriorly of the furnace through a seal lock 125, or the like, for external connection to hydraulic, pneumatic or other suitable life means (not shown) of a type comparable to the lift means 80 employed with the receiving chamber pot 66. The flow path within the casting zone between the receiving pot 121 and cold mold 117 may then be provided as by means of a cooled tundish 127. The tundish 127 thereby gravity feeds molten material from the receiving pot 121 into the bore of the cold mold 117.

The arrangement of FIG. 7 further includes means which may be operated in association with the hereinbefore noted selective relative movement between the receiving pot 121 and feed tube 122 to control the initiation and termination of molten material flow between the hearth pot 48 and receiving pot 121. In this regard the tundish 124 is preferably pivotal about an axis in a plane parallel to that of FIG. 7, as indicated schematically by the arrow 128. The tundish may accordingly be pivoted to a position which is unobstructing to the upper end of the feed tube 122, and wherein the flow of molten material out of the end of the tundish is diverted from the feed tube to a temporary collecting receptacle or the like (not shown) disposed substantially laterally of the feed tube. A gate or the like may be additionally employed in association with tundish 124 to selectively shut-off flow therethrough. In addition, means are provided to selectively vacuum seal the feed tube when, for example, the liquid seal effected by immersion of the lower end of the feed tube in molten material within the receiving pot 121 is broken. To this end, a plug 129 in association with a conventional translating mechanism, as generally depicted at 131, and adapted for selective coaxial movement into and out of sealing engagement with the upper end of the feed tube when the tundish 124 is moved to its unobstructing position, may, for example, be provided.

Alternatively, a valve or similar seal means may be provided in the feed tube 122.

It will be appreciated that the arrangement just described enables a relatively effective vacuum seal to be maintained between the processing zone and the casting zone 43. The casting zone may accordingly be maintained at relatively high pressures of the order of an atmosphere wherein heating of the material within the receiving pot 121, tundish 127 and the upper end of the cold mold 117, to maintain such material molten, may be efficiently accomplished by plasma torches 132, as depicted in FIG. 7, electric arcs or other heating means which are highly efficient at relatively high pressures. In addition, since relatively high pressures of the order of atmospheric may be maintained within the casting zone, seal problems at the point of egress of an ingot continuously emerging from the cold mold to outside atmosphere are greatly minimized. In fact, as indicated in FIG. 7, no seal lock need even be provided in association with the cold mold 117, and molten material introduced thereto may be readily formed into an ingot 133 which continuously emerges to outside atmosphere at a relatively high linear rate. By virtue of the relatively high rate at which the material progresses through the cold mold, the ingot 133 at exit from the cooling jacket 119 is sufficiently hot that further cooling may be desired. To this end, nozzles 134 may be mounted upon the cooling jacket to direct jet sprays of coolant directly upon the ingot as it emerges therefrom. In addition, by virtue of the relatively high linear rates involved, it may be desirable to periodically cut the ingot into sections as it emerges. For this purpose, a conventional flying cut-off system (not shown) may, for example, be employed. As one further significant advantage accruing from the arrangement of FIG. 7 whereby the casting zone may be maintained at relatively high pressure, casting of molten material therein may be readily conducted in an inert gaseous atmosphere, desirable in some casting processes.

Initial start-up, shut-down and subsequent start-up procedures associated with the arrangement of FIG. 7 are somewhat analogous to those hereinbefore described relative to the arrangement of FIG. 5. More particularly, at initial start-up there is no molten material within the receiving pot 121 to vacuum seal the feed tube and thereby vacuum seal the processing zone 44 and casting zone 43 from each other whereby they may be respectively maintained at relatively low and high pressures. The plug 129 at this time cannot be employed to seal the feed tube inasmuch as molten material from hearth pot 48 is introduced thereto in the initial filling of the receiving pot 121. Accordingly, in order that high vacuum may be established and maintained in the processing zone 44, prior to and during initial start-up, the casting zone 43 is best initially maintained at low pressure until such time as vacuum sealing of the feed tube can be effected. This may be readily facilitated as by means of a dummy ingot (not shown) inserted within the bore 118 of cold mold 117, and vacuum pump means 136 communicated with the casting zone selectively operable to exhaust same to low pressure. Hence, with the dummy ingot inserted in the mold 117 and the pump means 136 operable to establish a low pressure within the casting chamber, the processing zone 44 may be readily maintained at a high vacuum prior to and during initial start-up. The purified molten material from hearth pot 48 flows through tundish 124 into feed tube 122, from which the molten material streams into the receiving pot 121. The plasma torches 132 or other heating means within the casting zone have been previously rendered operable so as to maintain the material introduced to the pot in molten condition. With the receiving pot in a suitable upward position, the molten material within the pot rises to a level sufficient to immerse the lower end of the feed tube and thereby establishes a vacuum seal. At this level, the molten material also flows from the receiving pot, through tundish 127, into the bore of cold mold 117. As the cold mold is filled with the molten material, the dummy ingot is withdrawn therefrom to permit the continuously formed ingot 133 to emerge from the mold. Upon withdrawal of the dummy ingot, the vacuum seal between the casting zone and outside atmosphere is broken and the casting zone is ported to atmospheric pressure. A vacuum valve (not shown) may be additionally provided in communication with the casting zone, if desired, to augment porting of same to atmosphere. When the casting zone is ported to atmosphere, or otherwise maintained at relatively high pressure, operation of the pump means 136 is of course terminated. Thereafter, molten material from the hearth pot 48 continuously flows through tundish 124 and feed tube 122 into receiving pot 121, and then from the receiving pot through tundish 127 into the cold mold, while the processing zone 44 and casting zone 43 are vacuum sealed from each other and respectively maintained at relatively high and low pressures.

Shut-down of flow between the hearth pot 48 and cold mold 117 may be effected by first pivoting tundish 124 to a position which is unobstructing to the upper end of the feed tube 122 and wherein the flow of molten material is diverted from the feed tube. The plug 129 is next translated into sealed engagement with the upper end of the feed tube to thus provide an auxiliary vacuum seal between the processing zone 44 and casting zone 43. The receiving pot 121 is now translated downwardly such that the lower end of the feed tube 122 is no longer immersed in the molten material within the receiving pot, and the vacuum seal thereat is broken. Vacuum sealing of the feed tube is, of course, now facilitated solely by the plug 129. Since the lower end of the tube is now open, molten material within the tube drains into the receiving pot, and there is no danger of the tube freezing up. The plasma torches 132 or other heating means employed in the casting chamber may be then de-energized to complete the shut-down procedure.

Following a shut-down of the foregoing type, start-up may be initiated upon first re-energizing the plasma torches 132, or other heating means within the casting zone 43, to render the material within the receiving pot 121, tundish 127, and upper end of the cold mold 117 again molten. The receiving pot is translated upwardly to immerse the lower end of the feed tube 122 in the molten material within the pot, and thus re-establish the vacuum seal thereat. The plug 129 may be then translated upwardly out of sealed engagement with the feed tube and the tundish 124 pivoted to its original position. Continuous flow of molten material from the hearth pot 48 to the cold mold 117 is thus re-established.

Considering now the overall operation of the furnace 36 illustrated in FIG. 2, in the conduct of a metal purification process, there is first provided a supply of metal to be processed which has been smelted in a conventional manner, as in a non-vacuum open hearth furnace, and accordingly is in a premelted semipurified condition. More particularly, the premelted metal, having undergone conventional smelting processing, is to a large extent free of solid impurities, which have been removed as a slag. With suitable vacuum conditions established in the stages 44*a*, 44*b* of the processing zone 44, and atmospheric pressure being maintained in the receiving zone 42, the particular feed tube arrangement employed being at this time blocked, as by means of the diaphragm 86, to vacuum seal the receiving zone from the processing zone, the premelted metal is continuously introduced through chute 63 to the receiving pot 66. The material within the receiving pot is continuously heated by means of the arc emanating from electrode 76, or the like, in order to maintain the material in molten condition. In addition, the heating separates some of the remaining solid impurities from the metal, such impurities floating atop the melt contained in the receiving pot as a slag. Some amount of volatile impurities may be evolved to the surronding atmospheric pressure within the receiving chamber due to the heating. When the level of molten material within the receiving pot rises sufficiently to immerse the end of the feed tube 69, same is opened by any suitable mechanism, such as those described hereinbefore, and the vacuum seal between the receiving zone and stage 44*a* of the processing zone 44 is at this time maintained due to the feed tube being immersed within the molten material within the receiving pot 66. The pressure gradient between the receiving zone and the processing zone is now effective in forcing the molten material within the receiving pot to continuously flow through the feed tube 69 into the hearth pot 47. The feed tube is immersed to a sufficient depth beneath the surface of the molten material within the receiving pot that any slag floating thereon does not enter the feed tube and accordingly the material introduced to the hearth pot 47 is virtually free of slag.

The metal received by the hearth pot 47 may be maintained therein for a relatively long residence time through appropriate design of the pot. More particularly, the hearth pot may be shallow, and have an area of about one sq. ft. per 500 lbs/hr. of metal throughput to provide a suitable residence time of the material within the pot prior to flowing through the channel 51 to the hearth pot 48. In addition, there is provided a large surface of the molten material contained in the pot for subjection to bombardment heating by the particle beams directed thereon from the sources 58*a*. Accordingly, volatile impurities and occluded gases are very effectively evaporated from the melt within the hearth pot 47 and removed by the pump means 57*a*. Moreover, by virtue of the long residence time of the material within the hearth pot 47, various alloying elements can be added thereto and very effectively combined therewith, as described hereinafter. Similarly, the hearth pot 48 within stage 44*b* of the processing zone may be appropriately designed to provide a large capacity for molten material at a long residence time, and a large surface area. The material, upon entering the hearth pot 48, may accordingly be subjected to further evaporation processes, by means of the bombarding particle beams emitted from sources 58*b* and additional alloying elements may be combined with the melt. The highly purified metal or alloy is then delivered from the hearth pot 48 to the casting zone 43 and cast in any desired manner therein, such as by means of the cold mold 99.

The furnace 36 may, of course, be shut down in accordance with the procedures described hereinbefore entailing sealing of receiving zone 42 from atmosphere, evacuation of same to low pressure, and effecting relative movement between the receiving pot 66 and feed tube 69 commensurate with withdrawal of the tube from the molten material within the receiving pot. Subsequent to shut-down, the start-up of the furnace may be accomplished as previously described by re-immersing the feed tube 69 within the receiving pot 66 and re-establishing atmospheric pressure within the receiving chamber. Start-up and shut-down of the feed of molten material from the receiving pot to the processing zone 44 may be conducted in appropriate conjunction with start-up and shut-down of flow of metal into the casting mold 99, or the like, which procedure may be accomplished, for example, by means of a gate (not shown) retractably insertable into the tundish 106, or an equivalent flow control mechanism, such as embodied in the arrangement of FIG. 7.

There is shown in FIG. 8 a partial cross-sectional view of the processing zone and casting zone of a furance in accordance with the present invention that is particularly adapted for the production of a high purity metal alloy. The furnace 200 is generally similar to that shown in FIGS. 1 and 2 and includes a receiving zone, not shown, of the type generally described above, a processing zone 202, divided into two processing stages 204,206, and a casting zone 208. A feed tube 210 extends in vacuum sealed relationship between the molten pool of feed stock maintained in the receiving zone and the molten pool of material in a hearth pot 212 within the processing stage 204 of the processing zone 202. The hearth pot 212 is in communication with a second hearth pot 214 in the second processing stage 206, and a vacuum seal is maintained between the processing stages 204 and 206 by means of an intermediate wall 216 terminating in a baffle 218 which extends below the level of the molten material flowing from the hearth pot 210 to the hearth pot 214. The molten material is delivered from the heatth pot 214 in the second processing stage 206 into the casting zone 208 in the manner previously described through a vacuum sealed feed tube 220 and is delivered into a suitable holding receptacle 222. A tundish or the like is provided for delivery of the molten material from the holding receptacle 222 to a casting mold 224. Since as discussed hereinafter, it is usually desired to maintain the casting zone at a relatively low pressure in order to facilitate the addition of alloying agents, the casting mold may be provided with a seal lock 226 for egress of the ingot from the casting zone to the exterior of the furnace. Electron gun heating means 228,230,232 may be provided in the previously described manner in the processing stages and casting zone, for heating of the molten material.

In accordance with the present invention, means are provided in one or more of the processing stages 204,206 and casting zone 208 for the addition of alloying agents to the molten material. Such means may include one or more motor driven reels 234,236,238 of wire or strip alloying agents which are fed off the reels and immersed in the molten pool whereupon the alloying agent is dissolved and mixed with the molten material to provide an alloy of the desired composition. The use of shallow hearth pots 204,206 having a large surface area and electron beam heating causes thermal currents to be established in the molten pool in the hearth pots resulting in intimate mixing of the alloying agent throughout the molten material. Accordingly, the alloy product has a uniform composition.

Alloying agents may be added to the molten material in the processing zone and/or casting zone depending upon the vapor pressure of the alloying agents. Alloying agents having low vapor pressures such that they will not be vaporized at the usual operating conditions within the processing zone may be added in any one of the processing stages within the processing zones. Alloying agents having relatively higher vapor pressures, such that they would be vaporized at the usual operating conditions within the processing zone, may be added in one of the last processing stages which may be maintained at a suitable higher pressure so that the alloying agent will not be vaporized. It is also possible to add alloying agents having higher vapor pressures to the molten material in the casting zone of the furnace as shown in FIG. 8.

The absolute pressure in the processing stages and casting zone subsequent to the point at which the alloying agent or agents is added must be maintained at a pressure above the vapor pressure of the added alloying agent in order to prevent vaporization of the alloying agent.

Suitable X-ray spectrographic or other measuring apparatus 240,242 may be provided to analyze the alloy composition. The output from the measuring apparatus may be employed to drive the reels containing the alloying agents in order to provide an alloy product having the desired composition.

The furnace illustrated in FIG. 8 may be advantageously employed in the manufacture of a high purity alloy steel. A molten steel base metal may be continually introduced into the processing zone 202 through the feed tube 210 from a receiving zone as previously described. The first stage 204 of the processing zone is maintained at a pressure of about 10 microns of mercury, absolute, or less, and the molten steel is maintained in the first processing stage for an average residence time of between about 0.1 to about 0.2 hours and is heated to a temperature about 100° F above its melting point. The desired residence time within the first processing stage is attained by means of a hearth pot 212 having an area of about one square foot per 500 lbs per hour throughput and a depth of about 0.2 feet. Approximately 90 percent of the carbon-monoxide and oxygen, and substantially all of the hydrogen, are volatilized from the molten steel in the first processing zone. A pressure of about 10 microns of mercury or less within the first processing stage 204 allows for the addition of nickel, molybdenum and chromium alloying agents to the molten steel, and during the residence period of the steel within the first process zone, the alloying agents are intimately mixed with the steel to provide a uniform alloy composition. The molten steel containing the alloying agents continuously flows to the second processing stage 206 for further purification and the addition of further amounts of alloying agents. The spectrographic appratus 240 measures the alloy composition of the molten steel entering the second processing stage 206 and additional additions of the nickel, molybdenm and chromium alloying agents are controlled by the spectrographic apparatus to obtain the desired alloy composition. The second processing stage may be maintained at a pressure of about 0.5 micron of mercury or less to effect further removal of the remaining carbon monoxide and oxygen. The nickel, molybdenum and chromium alloying agents have a low vapor pressure and are not vaporized at the operating conditions within the processing zone. The second processing stage has an area of one square foot per 250 pounds per hour throughput, and a residence time of about 0.2 to 0.4 hours.

If the desired alloy composition includes only nickel, molybdenum and chromium alloying agents, the molten material may be continuously withdrawn from the second processing stage 206 and delivered into the cold mold 224 in the above described manner. However, if the alloy composition is to include manganese, the molten material must be first held for a residence period of about 0.2 hours in a relatively high pressure zone, during which time the manganese alloying agent is added to the molten material and mixed therewith. The manganese alloying agent may be added in an additional processing stage within the processing zone, or as illustrated in FIG. 8, the manganese may be added to the molten material in the holding crucible within the casting zone, which casting zone is maintained at the desired pressure of about 10 millimeters of mercury, absolute, in order that the manganese will not be vaporized excessively.

Changes in the composition of the alloy may be affected by altering the flow rate of the molten material through the furnace and/or by altering the feed rate of the alloying agents into the molten material. By careful adjustment of the flow rate of the molten material and the feed rate of the alloying agents, and by means of utilizing spectrographic measuring apparatus to determine the alloying composition in the varius processing zones, alloys may be produced at high throughput rates having closely controlled compositions.

Although the method and apparatus of the present invention has been particularly set forth in order to describe the invention, it is contemplated that various alternate embodiments within the skill of the art might be employed.

Various of the features of the invention are set forth in the following claims.

What is claimed is:

1. A high vacuum furnace for treating metals and alloys comprising, an air tight enclosure including a receiving zone, a processing zone, and a casting zone, an air tight barrier wall separating each of said zones, a hearth within said processing zone for receiving molten material to be treated, electron beam beating means for heating the molten material in said processing zone, pump means for exhausting said processing zone to a low absolute pressure, means for introducing molten material into said receiving zone, a receptacle within said receiving zone for receiving the molten material, means for heating the material in said receptacle, pump means for exhausting said receiving zone to a low absolute pressure, a feed tube extending in sealed relation through said barrier between said receiving zone and said processing zone, one end of said feed tube being positioned so as to be disposed within said receptacle below the normal level of molten material therein and the other end terminating adjacent said hearth, means for effecting relative movement between said feed tube and said receptacle so as to remove said one end of said feed tube from below the level of molten material in said receptacle, means for selectively sealing said feed tube, means defining a sealed flow path between said processing zone and said casting zone through said barrier therebetween, and means in said casting zone for receiving the molten material for withdrawal from the furnace.

2. A high vacuum furnace for treating metals and alloys comprising, an air tight enclosure including a receiving zone, a processing zone, and a casting zone, an air tight barrier wall separating each of said zones, a hearth within said processing zone for receiving molten material to be treated, electron beam heating means for heating the molten material in said processing zone, pump means for exhausting said processing zone to a low absolute pressure, means for introducing molten material into said receivinb zone, a first receptacle within said receiving zone for receiving the molten material, means for heating the material in said first receptacle, pump means for exhausting said receiving zone to a low absolute pressure, a first feed tube extending in sealed relation through said barrier between said receiving zone and said processing zone, one end of said first feed tube being positioned so as to be disposed within said first receptacle below the normal level of molten material therein and the other end terminating adjacent said hearth, a second receptacle within said casting zone, a second feed tube extending in sealed relation through said barrier betweeen said processing zone and said casting zone for gravity flow of molten material from said hearth to said second receptacle, one end of said second feed tube positioned so as to be disposed within said second receptacle below the normal level of molten material therein, means for effecting relative movement between said second feed tube and said second receptacle so as to remove said one end of said feed tube from below the level of molten material in said second receptacle, means for selectively sealing said second feed tube, and means within said casting zone for receiving molten material from said second receptacle for withdrawal from the furnace.

3. A high vacuum furnace for treating metals and alloys comprising, an air tight enclosure including a receiving zone, a processing zone, and a casting zone, an air tight barrier wall separating each of said zones, a hearth within said processing zone for receiving molten material to be treated, electron beam heating means for heating the molten material in said processing zone, pump means for exhausting said processing zone to a flow absolute pressure, means for introducing molten material into said receiving zone, a first receptacle within said receiving zone for receiving the molten material, means for heating the material in said first receptacle, pump means for exhausting said receiving zone to a low absolute pressure, a first feed tube extending in sealed relation through said barrier between said receiving zone and said processing zone, one end of said first feed tube being positioned so as to be disposed within said first receptacle below the normal level of molten material therein and the other end terminating adjacent said hearth, means for effecting relative movement between said first feed tube and said first receptacle so as to remove said one end of said first feed tube from below the level of molten material in said first receptacle, means for selectively sealing said first feed tube, a second receptacle within said casting zone, a second feed tube extending in sealed relation through said barrier between said processing zone and said casting zone for gravity flow of molten material from said hearth to said second receptacle, one end of said second feed tube positioned so as to be disposed within said second receptacle below the normal level of molten material therein, means for effecting relative movement between said second feed tube and said second receptacle so as to remove said one end of said feed tube from below the level of molten material in said second receptacle, means for selectively sealing said second feed tube, and means within said casting zone for receiving molten material from said second receptacle for withdrawal from the furnace.

4. A high vacuum furnace for treating metals and alloys comprising, an air tight enclosure including a receiving zone, a processing zone, and a casting zone, an air tight barrier wall separating each of said zones, said processing zone including a plurality of processing stages, a hearth extending through said processing stages for receiving molten material to be processed, electron beam heating means for heating the molten material in said processing stages, pump means for exhausting each of said processing stages to a low absolute pressure, means for introducing molten material into said receiving zone, a first receptacle within said receiving zone for receiving the molten material, means for heating the material in said first receptacle, pump means for exhausting said receiving zone to a low absolute pressure, a first feed tube extending in sealed relation through said barrier between said receiving zone and said processing zone, one end of said first feed tube being positioned so as to be disposed within said first receptacle below the normal level of molten material therein and the other end terminating adjacent said hearth, means for effecting relative movement between said first feed tube and said first receptacle so as to remove said one end of said first feed tube from below the level of molten material in said first receptacle, means for selectively sealing said feed tube, a second receptacle within said casting zone, a second feed tube extending in sealed relation through said barrier between said processing zone and said casting zone for gravity flow of molten material from said processing zone to said casting zone, one end of said second feed tube positioned so as to be disposed within said second receptacle below the normal level of molten material therein, and means within said casting zone for receiving molten material from said second receptacle for withdrawal from the furnace.

5. A high vacuum furnace for treating metals and alloys comprising, an air tight enclosure including a receiving zone, a processing zone, and a casting zone, an air tight barrier wall separating each of said zones, said processing zone including a plurality of processing stages, a hearth extending through said processing stages for receiving molten material to be processed, electron beam heating means for heating the molten material in said processing stages, pump means for exhausting each of said processing stages to a low absolute pressure, means for introducing molten material into said receiving zone, a first receptacle within said receiving zone for receiving the molten material, means for heating the material in said first receptacle, pump means for exhausting said receiving zone to a low absolute pressure, a first feed tube extending in sealed relation through said barrier between said receiving zone and said processing zone, one end of said first feed tube being positioned so as to be disposed within said first receptacle below the normal level of molten material therein and the other end terminating adjacent said hearth, means for effecting relative movement between said first feed tube and said first receptacle so as to remove said one end of said first feed tube from below the level of molten material in said first receptacle, means for selectively sealing said first feed tube, a second receptacle within said casting zone, a second feed tube extending in sealed relation through said barrier between said processing zone and said casting zone for gravity flow of molten material from said processing zone to said casting zone, one end of said second feed tube positioned so as to be disposed within said second receptacle below the normal level of molten material therein, means in at least one of said processing zone and said casting zone for introducting an alloying agent into molten material therein, and means in said casting zone for receiving the molten material for withdrawal from the furnace.

6. A method for the manufacture of a metal alloy product comprising, providing a molten base metal, passing the molten base metal through a series of vacuum zones adapted to be maintained at low absolute pressures, heating the base metal in said vacuum zones to maintain the base metal in molten form, adding a first alloying agent to the base metal in a first vacuum zone at a first absolute pressure that is above the vapor pressure of the first alloying agent, maintaining the absolute pressure in all vacuum zones subsequent to the first vacuum zone at an absolute pressure that is above the vapor pressure of the first alloying agent, and adding a second alloying agent having a higher vapor pressure than the first alloying agent to the base metal containing the first alloying agent in a second vacuum zone at an absolute pressure that is above the vapor pressure of the second alloying agent, and maintaining the absolute pressure in all vacuum zones subsequent to the second vacuum zone at an absolute pressure that is above the vapor pressure of the second alloying agent.

7. In a method of refining metals, especially steel and alloys, which includes the steps of: at a low absolute pressure electron heating the melt to be refined, subsequently stopping said electron beam heating and subjecting the thus treated melt to additional heating while adding at least one alloying constituent to the melt, and plasma heating said melt while teeming the melt into a mold.

8. A method of refining metals, especially steel and alloys which includes the steps of: in a vacuum purely electron heating the melt to be refined for eliminating volatilizable impurities and subsequently stopping the said electron heating and subjecting the thus treated melt to a heating at least partially by ion beams.

9. An apparatus for refining metals, especially steel and alloys, which includes: first vacuum tight chamber, first container means arranged within said first chamber for containing molten material to be refined, first material supply means adapted to be connected to said first container means for furnishing thereto the basic material to be refined, electron beam means for heating the contents in said first contaner means, means for maintaining said first chamber at a low absolute pressure, second vacuum tight chamber, second container means arranged within said second chamber for containing molten material, means for transferring material from said first container means to said second container means, second material supply means adapted to be connected to said container means for conveying alloying constituents thereto, means for heating the contents in said second container means, means for maintaining said second chamber at a pressure independent of the pressure in said first chamber, a third vacuum tight chamber, a receptacle within said third chamber, means for transferring material from said second container means to said receptacle, and means for maintaining said third chamber under vacuum at an absolute pressure greater than the pressure in the second chamber.

10. An apparatus according to claim 9 which includes: plasma heating means associated with said receptacle.

11. An apparatus according to claim 10 in which said receptacle is a mold, and said mold has a retractable bottom.

12. An apparatus according to claim 11 in which said container means include at least one water-cooled container.

13. A method for the manufacture of a metal alloy product comprising, providing molten base metal, passing the molten base metal through a series of vacuum zones, electron beam heating the base metal in a first vacuum zone, maintaining a low absolute pressure in the first vacuum zone, adding an alloying agent to the molten base metal in a second vacuum zone, heating the molten base metal in the second vacuum zone, maintaining the absolute pressure in the second vacuum zone independent of the absolute pressure in the first vacuum zone, and maintaining the absolute pressure in all subsequent vacuum zones above the pressure of the second vacuum zone.

14. The method according to claim 13 wherein the absolute pressure in the second vacuum zone is greater than the vapor pressure of the alloying agent.

15. The method according to claim 13 wherein the step of providing a molten base metal comprises: melting a base metal in a receiving zone, and transferring the molten base metal from the receiving zone into the first vacuum zone.

* * * * *

UNITED STATES PATENT AND TRADEMARK OFFICE

CERTIFICATE OF CORRECTION

PATENT NO. : 4,027,722
DATED : June 7, 1977
INVENTOR(S) : Charles d'A. Hunt

It is certified that error appears in the above-identified patent and that said Letters Patent are hereby corrected as shown below:

Col. 2, line 14, "substantil" should read -- substantial --

Col. 2, line 32, "slat" should read -- slag --

Col. 5, line 48, "deliered" should read -- delivered --

Col. 6, line 19, "heart" should read -- hearth --

Col. 6, line 68, after "the" and before "tube" insert -- flow --

Col. 8, line 13, after "vacuum" and before "34" insert -- seal --

Col. 9, line 50, "ecompassing" should read -- encompassing --

Col. 10, line 11, "Various" should read -- various --

Col. 10, line 14, "commnly" should read -- commonly --

Col. 10, line 24, "grater" should read -- greater --

Col. 10, line 33, "frm" should read -- from --

Col. 10, line 63, "facilitste" should read -- facilitate --

Col. 12, line 54, "movemen" should read -- movement --

Col. 15, line 7, "is" should read -- in --

Col. 15, line 41, "mateial" should read -- material --

UNITED STATES PATENT OFFICE

CERTIFICATE OF CORRECTION

PATENT NO. : 4,027,722
DATED : June 7, 1977
INVENTOR(S) : Charles d'A. Hunt

It is certified that error appears in the above-identified patent and that said Letters Patent are hereby corrected as shown below:

Col. 16, line 67, "Alternatively" should read -- Alternately --

Col. 20, lines 20 and 21, "furance" should read -- furnace --

Col. 20, line 32, after "the" and before "processing" insert -- first --

Col. 21, line 59, "appratus" should read -- apparatus --

Col. 21, line 62, "molybdenm" should read -- molybdenum --

Col. 22, line 48, "beating" should read -- heating --

Col. 23, line 12, "recivinb" should read -- receiving --

Col. 23, line 46, "flow" should read -- low --

Col. 25, line 11, "introducting" should read -- introducing --

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*

UNITED STATES PATENT OFFICE

CERTIFICATE OF CORRECTION

PATENT NO. : 4,027,722

DATED : June 7, 1977

INVENTOR(S) : Charles d'A. Hunt

It is certified that error appears in the above-identified patent and that said Letters Patent are hereby corrected as shown below:

Col. 25 line 10, "at least one of" should be deleted.

Col. 25 line 11, "and said casting zone" should be deleted.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*